US008764105B2

(12) United States Patent
Gendell

(10) Patent No.: US 8,764,105 B2
(45) Date of Patent: Jul. 1, 2014

(54) OFFSET PYRAMID HINGE FOLDING CHAIR

(76) Inventor: Alexander Gendell, Hoboken, NJ (US)

( * ) Notice: Subject to any disclaimer, the term of this patent is extended or adjusted under 35 U.S.C. 154(b) by 182 days.

(21) Appl. No.: 13/136,441

(22) Filed: Aug. 1, 2011

(65) Prior Publication Data

US 2013/0033073 A1 Feb. 7, 2013

(51) Int. Cl.
*A47C 4/00* (2006.01)

(52) U.S. Cl.
USPC ..... 297/16.1; 297/16.2; 297/440.12

(58) Field of Classification Search
USPC ..... 297/440.12, 16.2, 17, 16.1
See application file for complete search history.

(56) References Cited

U.S. PATENT DOCUMENTS

| | | | | | |
|---|---|---|---|---|---|
| 181,225 | A * | 8/1876 | Travis | 248/434 |
| 1,344,431 | A * | 6/1920 | Albertie | 297/440.11 |
| 1,703,879 | A | 3/1929 | Goldwyn | |
| 1,789,295 | A | 1/1931 | Bauer | |
| 3,556,593 | A | 1/1971 | Speegle | |
| 3,606,459 | A | 9/1971 | Krone | |
| 4,108,490 | A | 8/1978 | Marin | |
| 4,334,710 | A | 6/1982 | Milner, Jr. | |
| 4,359,243 | A * | 11/1982 | Crutcher | 297/17 X |
| 4,533,179 | A * | 8/1985 | Nichols et al. | 297/440.12 |
| 5,044,690 | A * | 9/1991 | Torrey | 297/16.1 |
| 5,711,572 | A * | 1/1998 | Khan | 297/440.12 X |
| 5,752,743 | A | 5/1998 | Garelik | |
| 6,257,153 | B1 * | 7/2001 | Portugal | 108/115 |
| 7,052,081 | B2 | 5/2006 | Leng | |
| 2009/0174233 | A1 * | 7/2009 | Hoffman et al. | 297/16.2 |

* cited by examiner

*Primary Examiner* — Rodney B White
(74) *Attorney, Agent, or Firm* — Douglas C. Wyatt

(57) ABSTRACT

A folding chair having at least one offset pyramid hinge, two chair legs, a chair-backing, and a seating member which can fold substantially flat in a closed position, and can substantially lock open in an opened position. The offset hinge of the chair promotes the chair remaining in either a flattened or open position by positioning the intersecting junctions at apices which are offset from one another.

24 Claims, 10 Drawing Sheets

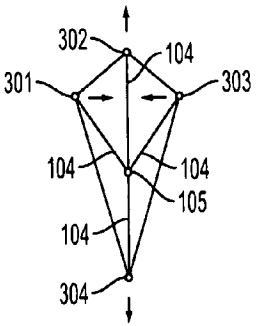
FIG. 8A
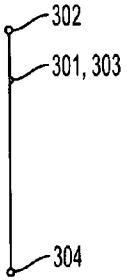
FIG. 8B
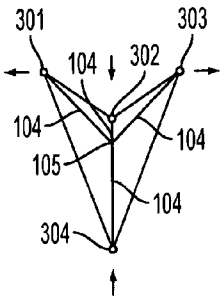
FIG. 8C
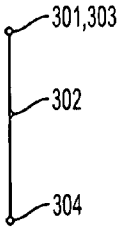
FIG. 8D
FIG. 9A
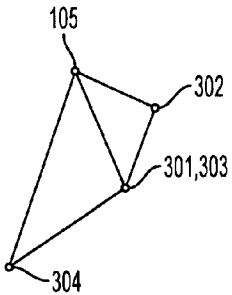
FIG. 9B
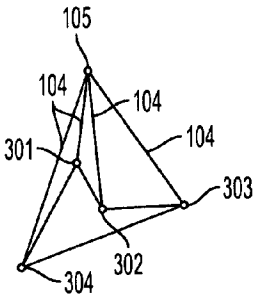
FIG. 9C
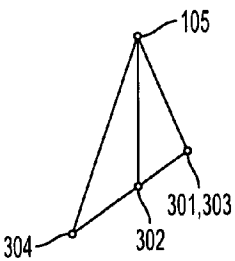
FIG. 9D

OFFSET PYRAMID HINGE FOLDING CHAIR

FIELD OF INVENTION

This invention is related to the art of foldable furniture, and more particularly related to a structure for a folding chair with a hinge utilizing the geometry of an offset pyramid. The pyramid support structure can be disposed in at least one closed and flat position, and can be disposed in at least one open and resting position. The structure includes at least four axes, which are offset from one another and at least two of which intersect at offset apices.

BACKGROUND OF THE INVENTION

Collapsible or folding seating devices are used in a variety of personal, household, and business environments, where collapsibility is essential for use, transport, and storage. Such seating devices known in the prior art typically utilized simple geometric patterns and were often made of rigid materials. Some improved folding seating devices include the use of more flexible materials and pivoting devices.

Accordingly, there is a need for an improved folding chair suitable for use in a variety of casual and professional environments. More particularly, there is a need for a folding chair that utilizes a user-friendly internal collapse mechanism for easy operation and storage. Moreover, a light-weight, yet durable chair that can be made from numerous flexible materials is desirable.

OBJECT OF THE INVENTION

It is an object of the invention to provide a folding chair with an efficient, user-friendly design that does not require extensive user manipulation and which can lock into an open position without complicated locking mechanisms. Another object of the invention is to provide a folding chair that does not utilize separate parts or requires assembly. Another object of the invention is to provide a folding chair that, when in an open position, is stable, sturdy, and suitable for a variety of uses. Another object of the invention is to provide a folding chair that can readily fold into a transport or storage position with minimal exertion. While it has been desirable to avoid torsional forces or other stresses in the design of a folding chair or other support structure, and it is an object of the present invention to impart torsional forces and/or other stresses to create a snapping effect which can dispose the chair to an open position, a closed position, or both. A further object of the invention is to provide a very thin folded piece of furniture having good rigidity and stability when opened.

SUMMARY OF THE INVENTION

A foldable chair with an offset pyramid hinge is provided suitable for use in a variety of personal, household, or business environments, where a seating device that can be easily opened for use with minimal user manipulation, time, and effort is desired. A foldable chair according to the invention is also adaptable for use for those who would like to transport or store the seating device in a closed state following use. Accordingly, a folding chair is provided comprising an offset pyramid hinge, two chair legs, a chair backing, and a seating member. The offset pyramid hinge provides an internal support structure for the foldable chair and contains four separate support members. Each support member has at least two faces and two edges that are connected to each other by flexible connections, such as hinges, to form a pyramid geometry when the chair is engaged in an open position. The basis of the hinge is a folding pyramid geometry, whereby moving a pair of two points in opposite planes towards each other in turn causes another pair of two opposite points to move further apart, and vice versa.

The two chair legs serve as the base and support the chair. A flexible connecting material, such as a metal hinge, connects each chair leg to the internal pyramid hinge. Moreover, when the chair is engaged in an open position, each chair leg extends from its distal end to contact and support the rear end of the chair backing. It can be appreciated that the chair backing can contain two symmetrical, pieces which are connected by a flexible material, such as a metal hinge, pivot, or similar support structure. The chair backing provides the means to engage or close the chair by applying force to the symmetrical pieces in a manner that opens or closes the hinges connecting the symmetrical pieces, respectively. The seating member provides the means for the user to sit in the chair and is connected to the offset pyramid hinge by a variety of means, such as screws, nails, or adhesive material, such as staples or glue, etc. It can be appreciated that the seating member can be made of a durable, yet comfortable material, preferably cloth, nylon, or the like. In an alternative embodiment, a rigid seat can be provided.

BRIEF DESCRIPTION OF THE DRAWINGS

Preferred embodiments of the inventive devices are illustrated in the drawings and are described below, though not necessarily to scale.

FIGS. 8A-D illustrate top views of a simplified representation of a pyramid support structure to illustrate aspects of an embodiment of the invention.

FIGS. 9A-D illustrate side perspective views of a simplified representation of a pyramid to illustrate aspects of an embodiment of the invention.

Figure 1:
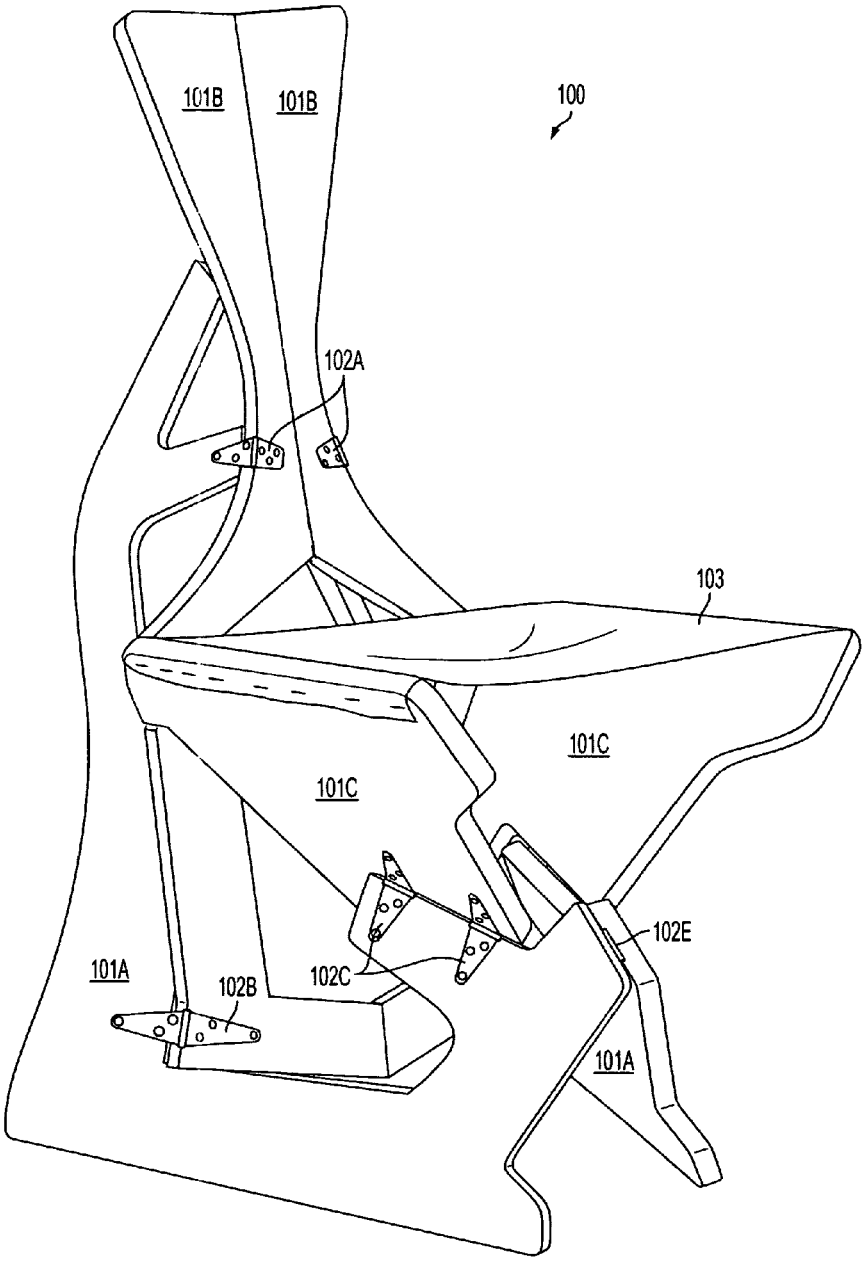
FIG. 1 illustrates a perspective view of a folding chair according to the invention in an open position.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION

A detailed description of an offset pyramid hinge folding chair is provided below for general applicability. In addition, several specific embodiments are provided as examples of the devices which one of ordinary skill in the art may apply these teachings to address specific problems and to illustrate the benefits and improvements of the system over known solutions.

Figure 2:
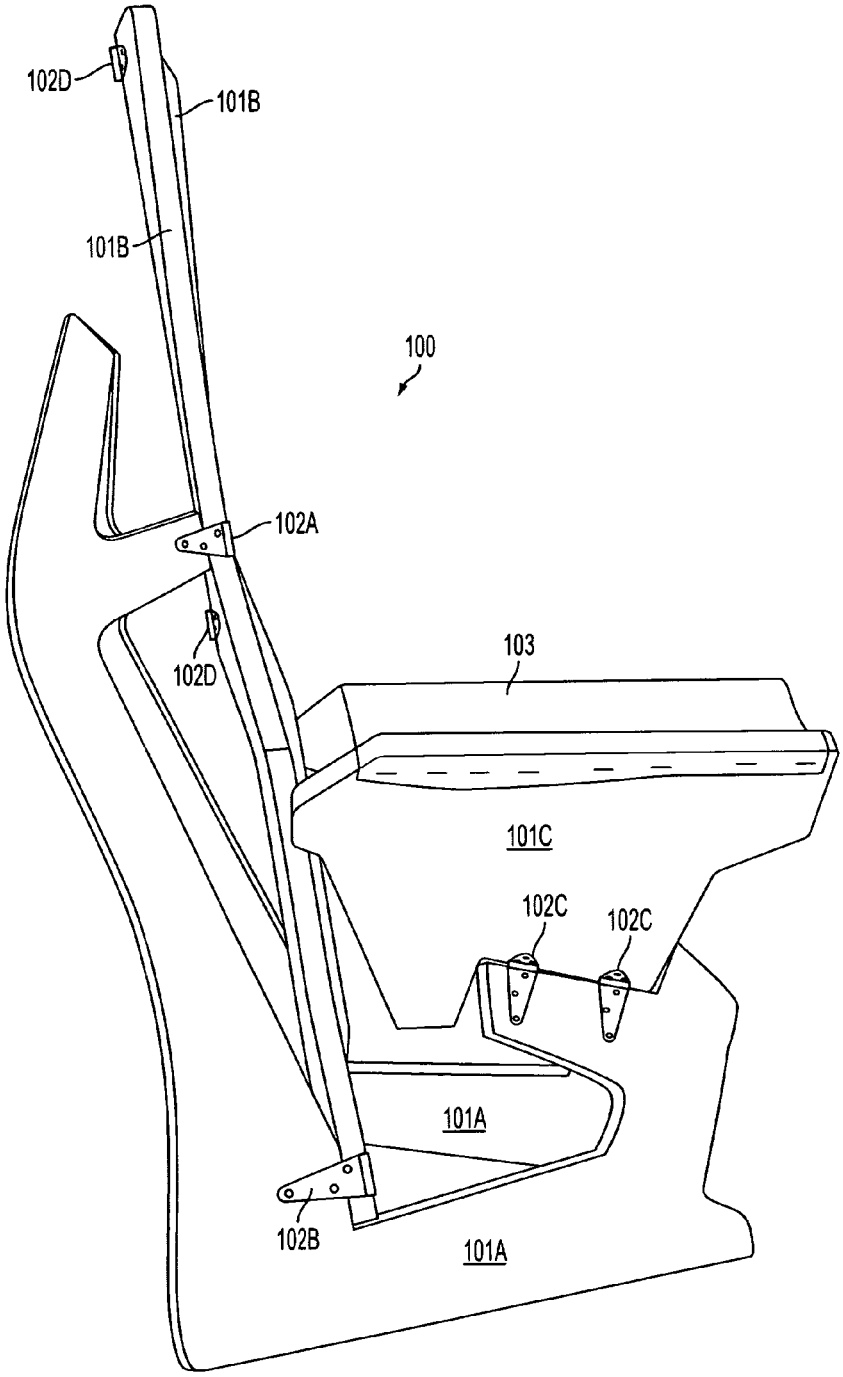
FIG. 2 illustrates a side perspective view of a folding chair of FIG. 1 in an open position.
Figure 3:
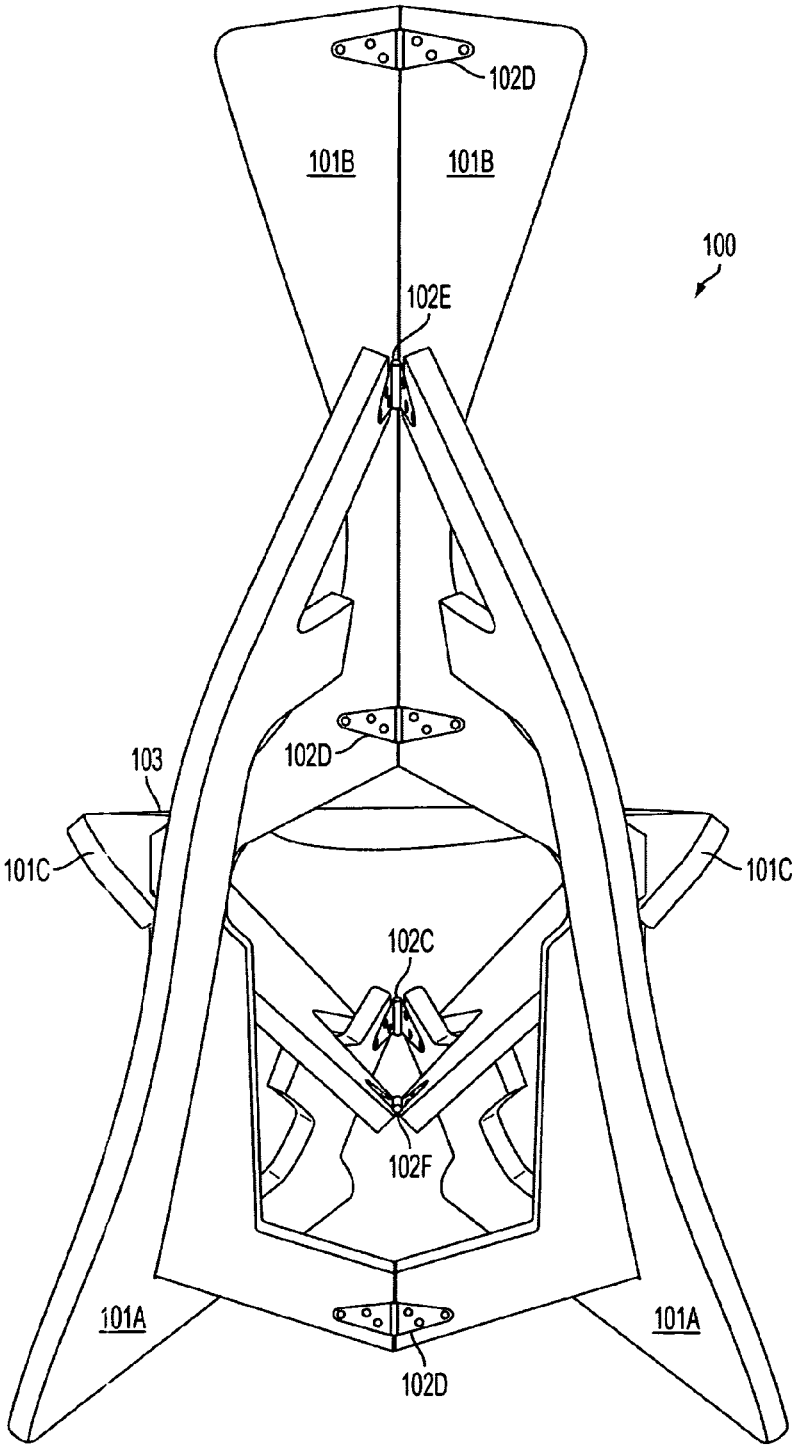
FIG. 3 illustrates a side rear view of the folding chair of FIG. 1 in an open position.

FIGS. 1, 2 and 3 illustrate perspective views of an embodiment of a double pyramid folding chair 100 in an open or locked position. FIG. 1 shows a side perspective view of the embodiment of a pyramid support structure 100 in an open position. FIG. 2 shows a side view of the embodiment of a pyramid support structure 100 in an open position. FIG. 3 shows a rear view of the embodiment of a pyramid support structure 100 in an open position.

In this configuration, a pair of matching leg support members 101A are connected to a pair of the chair backing support members 101B. In one embodiment, connections between the members, including the support legs 101A and the chair-backing members 101B can be made by providing one or more flexible connections 102, such as hinges, at each connection point. Other flexible connections include a flexible material, such as cloth, as well as pivots, such as ball and socket combinations, pivots, rods, dowels, and other things. For example, each of the pair of matching leg support members 101A are connected to corresponding matching back support members 101B by a first pair of upper hinges 102A and a second pair of lower hinges 102B.

A pair of matching seat support members 101C are attached to the legs 101A by a third intermediate pairs of hinges 102C. In one embodiment, the seat support members 101C are mounted on the top side of the lower portion of the leg members 101A as illustrated in FIGS. 1 and 2. Flexible seat material 103 is attached to the upper edges of the seat support members 101C to provide a seat for the chair 100.

Figure 4:
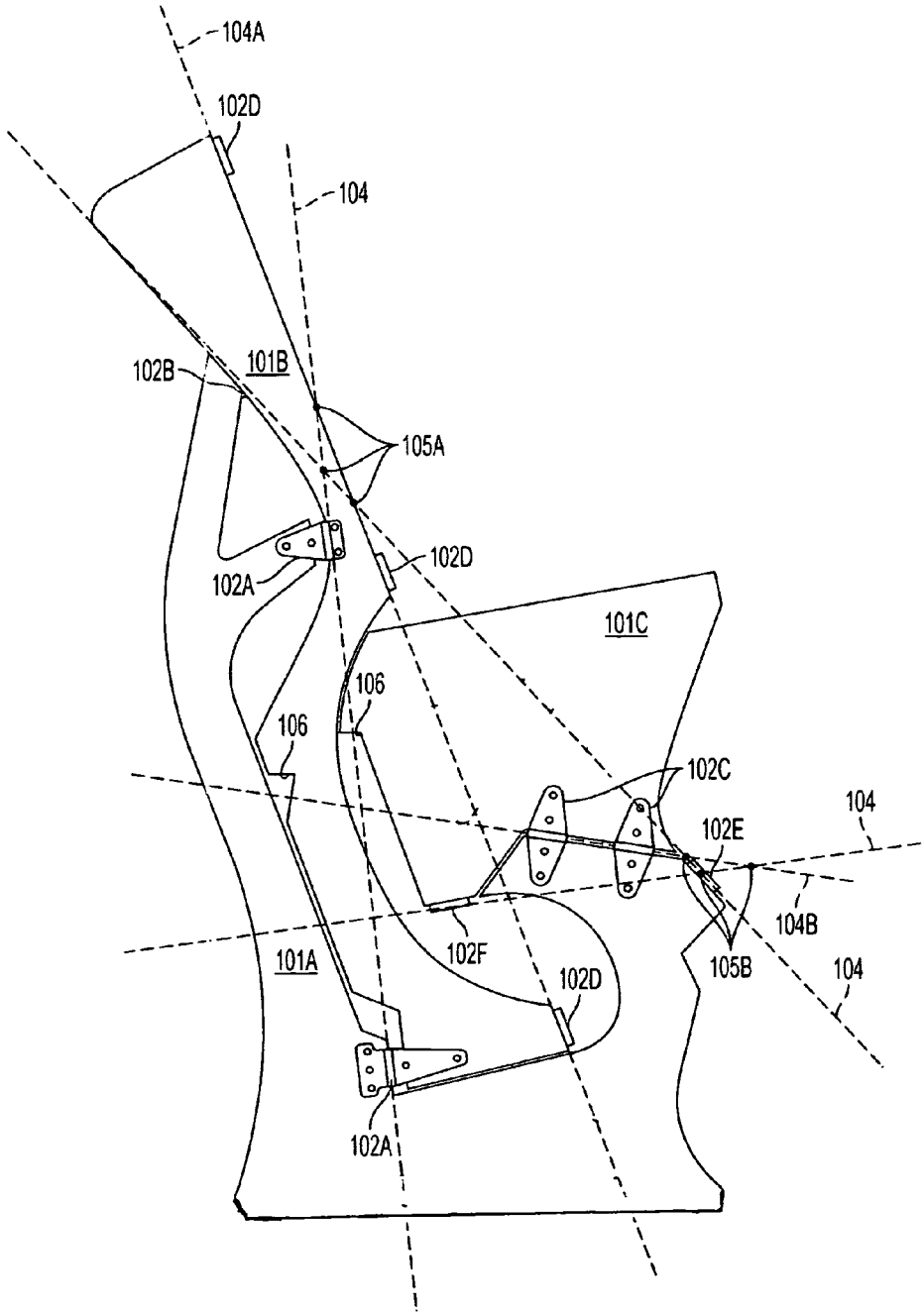
FIG. 4 illustrates a perspective side view of the folding chair of FIG. 1 in an open position.

FIG. 4 shows a side view of an embodiment of a double offset pyramid chair 100 in a closed position, and illustrates several aspects of the invention.

The double offset pyramid chair 100 in an open position can be closed and folded flat into a folded position shown in FIG. 4 by applying a force to cause the top portion of the chair back 101B to pivot toward a viewer of FIG. 3. Closing the chair backs 101B causes the lower leg members 101A and back members 101B to close concurrently by pivoting on the hinges 102 and the seat support members 101C come together by pivoting on corresponding hinges 102. In one embodiment, each of a pair of the leg members, back members and seat members are of matching shape so that when closed each member 102 lies flat next to the other member 101 of a pair.

Accordingly, an embodiment of the invention adapted as a folding chair 100 illustrated in FIG. 1 is made of three pairs of main support members 101, the legs 101A, the back 101B and seat supports 101C. The matching pairs of chair legs 101A, back members 101B and seat supports 101C provide the structural support for the double offset pyramid chair 100. In the open position of FIG. 1, the chair 100 is provided with a seat 103, which is preferably comprised of a flexible material such as canvas, and which is attached to the upper sides of the seat support members 101C. A person of ordinary skill of the art can appreciated that the seat can be formed of a rigid material.

In addition, each support member 100 is flexibly connected to a corresponding support member 100 of a pair by at least one hinge 102. As readily apparent to one skilled in the art, an embodiment of the open chair 100 can be folded into the flat configuration of FIG. 4 with the members 101 pivoted on their hinges 102 so that they come together with matching surfaces. For example, the back hinges 102D allow the back members to pivot around a first axis 104A at their junction from the open position in FIG. 1 to the closed or folded position of FIG. 4. The seat support members 101C are mounted on the chair leg members 101A by at least a third pairs of hinges 101C on a second center axis 104B so they can move into the open position of FIG. 1 to support the flexible chair seat 103 and into the closed or folded position where the flexible seat can be folded for storage.

It can be appreciated that each of the support members 101 can be formed of varying shapes according to their desired function. For example, the leg support members 101A can be formed to include chair feet, which alternatively can be provided separately. Similarly, each leg member 101A can include two portions: a horizontal portion whose base can contact and provide support against a floor, and a vertical support that cooperates with one or more support members, and can be incorporated as part of a first pair of support members 101 such as a horizontal support that can be formed to contact the other support members such as a chair backing 101B when the chair is in an open position. In addition, a catch 106 can be provided in one or more support members 101 of for stopping the range of motion of support members, creating a locking mechanism to improve stability, or providing a rest or seat for a corresponding surface to meet. For example, each member of a pair of chair backing members 102B can be provided with a first catch 106 and/or each member of a pair of chair seat members 102B can be provided with a corresponding second catch 106 which can cooperate with the first catch 106.

The double offset pyramid chair 100 is provided with a plurality of offset pyramid support structures which can cooperate to form the chair embodiment and which can impart varying strain in the material between the hinges 102 as the structure 100 is opened and closed which can create cause a variation in the resistance or force required while opening or closing the chair 100 and can be used to create a snapping quality. Each offset pyramid hinge can be provided by combining a plurality of support members 101 with axes 104 that are offset and intersect at offset apices 105. For example, in the embodiment shown in FIG. 4, the apices 105 are offset from one another when the structure is in a flattened position and the apices 105 are viewed from the side in FIG. 4. Because the apices are offset, the material between the flexible connections along an axis 104, such as the hinges in this embodiment, can experience torsional and other strain forces as the chair 100 is opened and closed.

By providing hinges which are offset, one can introduce strain forces during the opening and closing of the hinge which can provide a desirable snap. The offset comes from altering the basic pyramid geometry. For example, in one embodiment of a chair according to the invention, as the chair is opened or folded the offset causes stress on the members, and provides a desirable snap disposing the chair to relax into one of two possible positions. Such a hinge is useful in a folding, collapsible chair—in addition to other applications—where a slight "snap" is desired. Moreover, one of ordinary skill would appreciate that this offset pyramid hinge can take on a variety of different shapes and can be made from flexible materials other than what is specifically described here.

In the embodiment of the structure 100 shown in FIG. 4, at least two offset pyramid support structures are provided, each having at least two common support members 101 and at least two common hinges 102. A first pyramid support structure has two pairs of support members 101 connected by flexible connections which are associated with axes 104 that intersect in a side view at a first set of apices 105A which are offset from one another. A second pyramid support structure can also be provided having two pairs of support members 101 connected by flexible connections which are associated with axes 104 that intersect in a side view at a second set of apices 105B which are offset from one another.

Furthermore, the incorporation of a second pyramid support structure in cooperation with a first pyramid support structure can provide for additional mechanical locking effects. For example, in a structure provided in a flattened position, increasing force can be required to open the structure to a point between a fully closed or flattened position to a fully opened or locked position. Similarly, increasing force can be required to close the structure from a locked position to a point between a fully opened or locked position to a fully closed or flattened position. It can be appreciated that the forces desired for such effects can be modified by the choice of materials, the distance between the each set of apices associated with each pyramid support structure, as well and the relative angles formed by the junctions of the support members for each pyramid support structure and the offsets of their associated apices. Furthermore, by disposing the axes at acute or obtuse angles can affect whether or not the buildup of resistance or forces is gradual over a range of motion when the structure 100 is opened or closed.

Furthermore, hinges 102 of the offset pyramid hinge folding chair are provided on different planes, and thus can provide for additional or alternative offset. An offset is provided by disposing at least two of the axes on different planes from each other. For example, the first upper hinges 102A, the second lower hinges 102B, and third intermediate hinges 102C can be provided on the two outside planes outside the pairs of support members 101. Similarly, the back hinges 102D, the base hinges 102E and seat hinges 102F can be provided on an inside plane between pairs of support members 101.

It can be appreciated that at least one additional pair of support members can be provided with associated flexible hinges to connect each support member of the additional pair of support members and flexible hinges to connect the additional pair of support members to at least one other pair of support members. Additional pairs of support members 101 (not shown) can also be provided to cooperate with at least one other pair of support members, and can thereby form an additional pyramid support structures with associated axes 104 and apices 105 (not shown).

It can be appreciated that appropriate materials for construction of the offset pyramid hinge, the chair legs, and the chair backing can be flexible yet durable material such as wood, metal, plastic and composite materials, among other things. Moreover, the appropriate material for construction of the seating member can be one that is sturdy and comfortable for an up-right seating position, such as nylon, cloth, cushioning, or other flexible material.

Figure 5B:
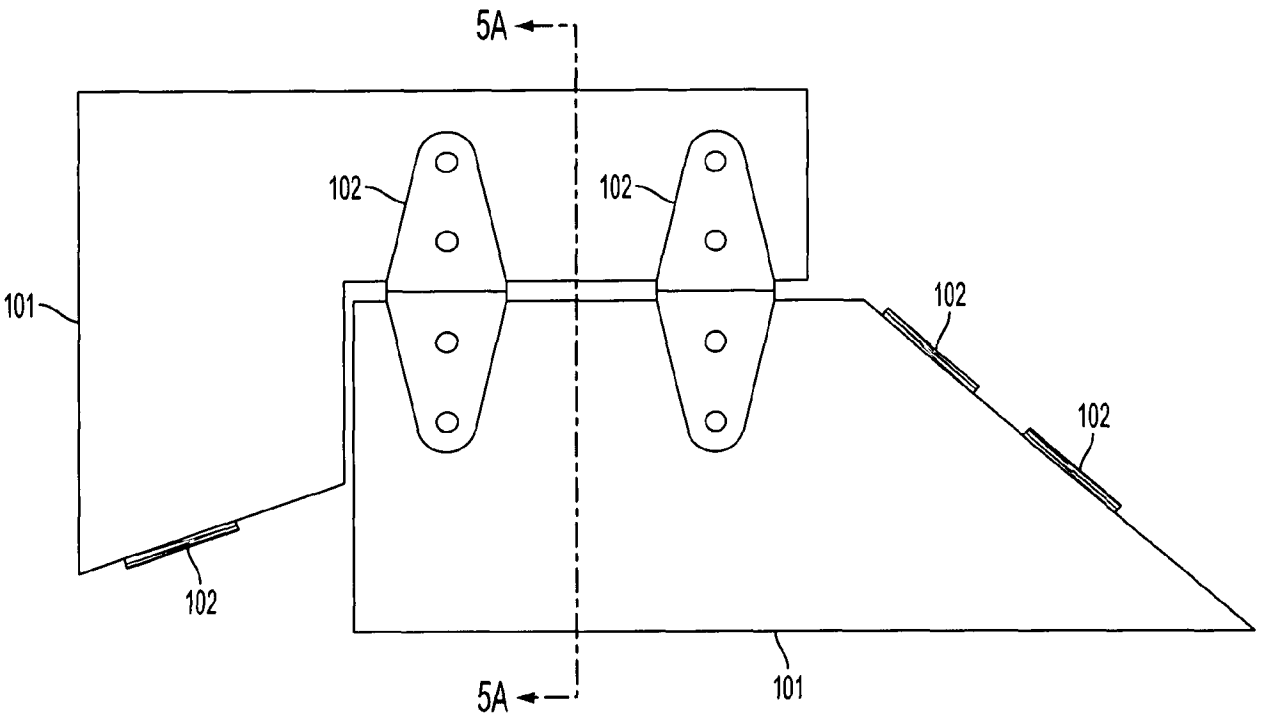
FIG. 5B illustrates a side face view of an embodiment of an offset pyramid hinge in a closed position.
Figure 5A:
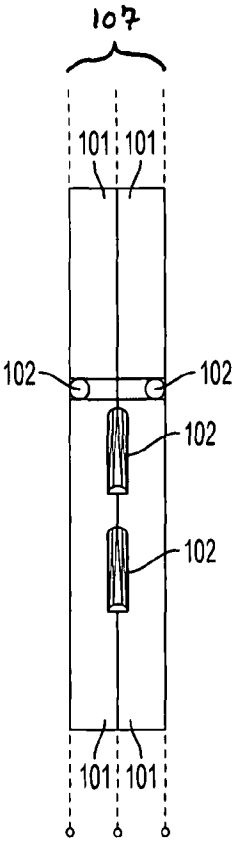
FIG. 5A illustrates a side edge view of an embodiment of an offset pyramid hinge in a closed position.

FIGS. 5A, and 5B illustrate an embodiment of a pyramid support structure 100 shown provided in a closed position. FIG. 5A shows a front view of an embodiment of a pyramid support structure 100, and FIG. 5B shows a side view of an embodiment of a pyramid support structure 100.

The pyramid support structure 100 includes at least four support members 101. Each support member has at least two faces and at least two edges. In FIG. 5B, two of the support members 101 are visible, each showing one face. Each support member is flexibly connected to two other support members by a flexible connection, such as by one or more hinges 102.

As shown in FIG. 5A, an embodiment of the pyramid support structure 100 includes at least two pairs of support members 201, such as a first pair of support members 201 and a second pair of support members 201. In one embodiment of the invention, each support member of a first pair can be connected to support member of a second pair on a one plane and can be connected to the other support member of the first pair on a different plane. For example, such planes can be where a hinge may be connected to the face of a support member. Similarly, in one embodiment of the invention, each support member of a second pair can be connected to support member of a first pair on a first plane 107 and can be connected to the other support member of the second pair on a different plane 107. Thus, as shown in FIG. 5A, one embodiment can be provided with flexible hinges disposed at three different planes, such as two outside planes and one inside plane when taken from an edge view. It can also be appreciated for purposes of this description that the support members can be paired differently, whereby FIG. 5B show one of the pairs of support members at one side of the pyramid support structure 100. Alternatively, one or more of the above-described flexible hinges can be provided whereby the pivot of the hinge is provided between the two support members to be connected and between the faces of at least one of the support members.

Figure 6:
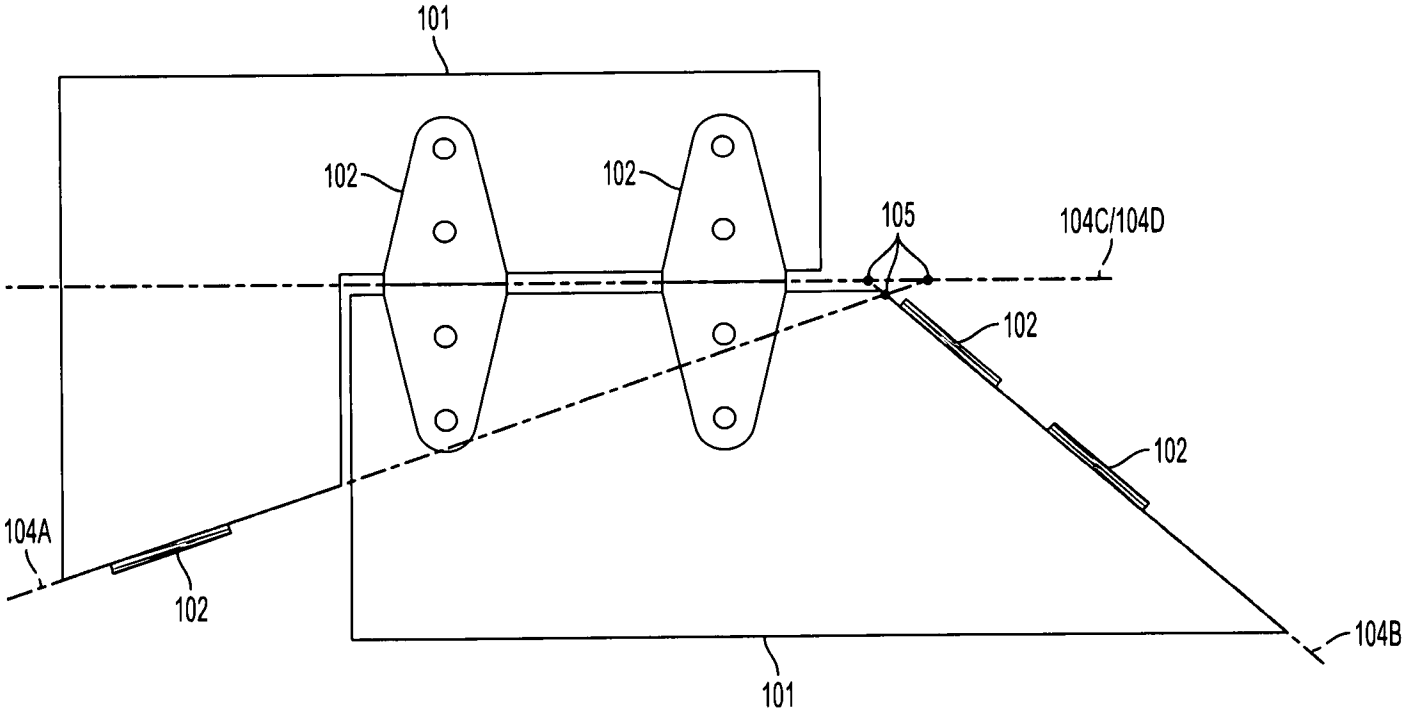
FIG. 6 illustrates a side face view of an embodiment of an offset pyramid hinge in a closed position.

FIG. 6 shows a side view of an embodiment of a pyramid support structure 100 in a closed position such as shown in FIG. 5B. Each support member is flexibly connected to two other support members at least two junctions, each junction corresponding to an axis 104 about which the members 101 move and interact. Each junction defines an intersection of two support members and can form part of an axis 104. Each axis 104 defines a hypothetical edge of an offset pyramid shape when the support structure 100 is in an open position. In the embodiment shown in FIG. 6, four axes are indicated by axes 104A, 104B, 104C and 104D. In FIG. 6, axes 104C and 104D overlap but are in different planes. As shown in FIG. 6, a first axis 104A can intersect a second axis 104B at an apex point 105 when viewed from the side in a closed position. In one embodiment of the invention, at least two apex points 105 are provided which are offset from one another. In the embodiment shown in FIG. 6, the apex points 105 are offset from one another in an X and Y direction when viewed from a side, as well as offset in a Z direction, as at least two of the apex points are provided on different planes in the closed position.

Figure 7A:
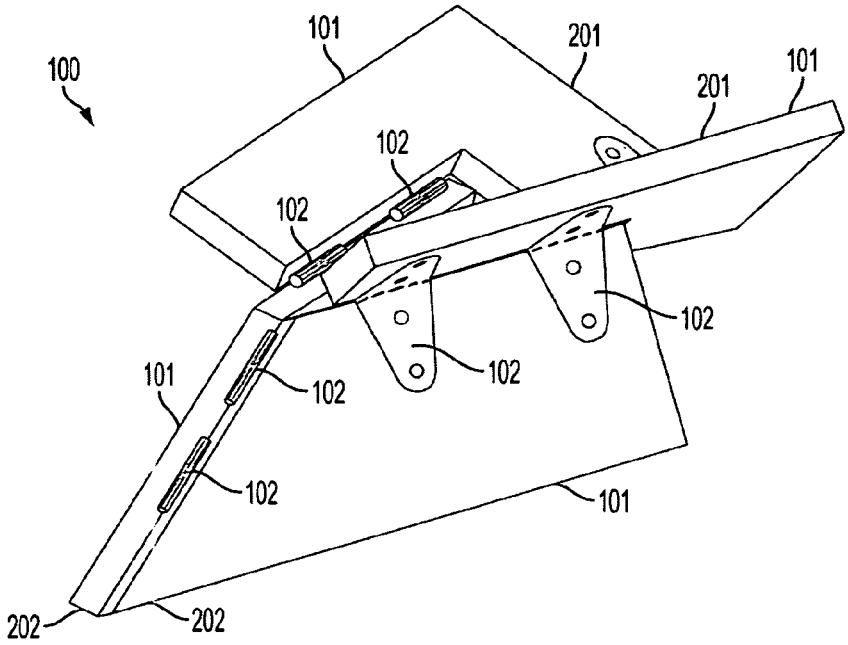
FIG. 7A illustrates a side perspective view of an embodiment of an offset pyramid hinge in an open position.
Figure 7B:
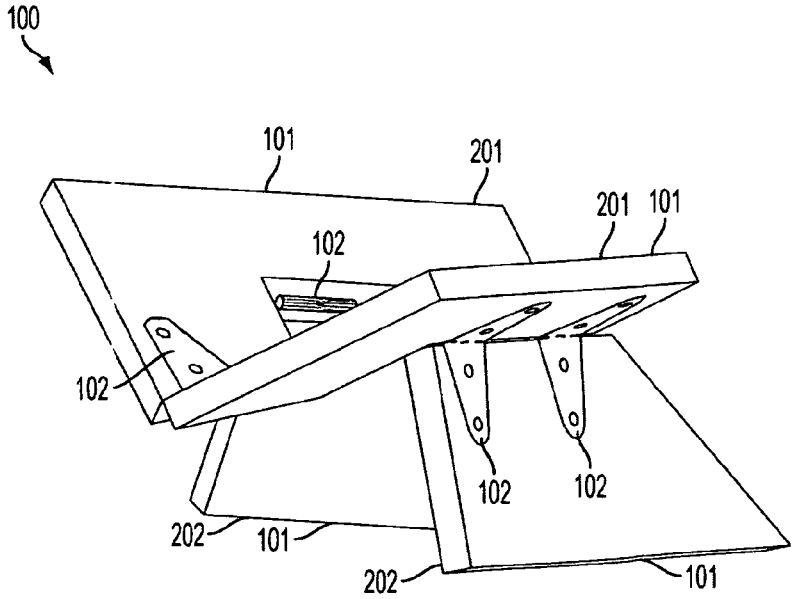
FIG. 7B illustrates an opposite side perspective view of an embodiment of an offset pyramid hinge in an open position.

FIGS. 7A and 7B show an embodiment of a pyramid support structure in front and rear perspective views, wherein the pyramid support structure 100 is in an open position. It can be appreciated that the shape of each support members 101, which includes the angle of the corner of a support member and/or angle where each axis 104 associated with an edge of a support member meets at an apex, as well as the thickness of the support member and distance from an edge of a support member to the axis associated with that edge, can all affect the performance of the pyramid support structure and a person of ordinary skill in the art can choose such dimensions in accordance with the desired effect in view of the teachings herein. For example, the relative geometries of the pyramid support structure 100 can provide for a structure which lies approximately flat in a closed position, such as shown in FIG. 5, and which has a fully open position, as shown in FIG. 7, whereat the pyramid hinge 200 can be opened no further.

The size and geometries of the support members 101 as well as the relative positions of the flexible hinges 102 in the drawings are provided for illustration purposes only and are not to scale. It is an object of the present invention to provide a pyramid support structure 100 which can have different embodiments having a variety of geometries.

The several axes 104 can be positioned to be offset from one another to affect the amount of resistance experienced—and accordingly the amount of force required—when flexing the structure 100 from one position to another. For example, in one such embodiment, the axes 104 can be offset to provide for an increase in resistance as the structure is opened from a closed or flat position to an open position or resting position. In addition, the axes 104 can be offset to provide for an increase in resistance as the structure is opened from a closed position to an open position or resting position, wherein the resistance increases to a maximum as the structure is opened and after reaching the maximum resistance, the resistance dissipates as the structure is opened further. Thus, by providing a pyramid support structure 100 in accordance with the invention, it is possible to provide an offset pyramid hinge with a snapping action which causes the structure to rest in a predetermined resting position upon overcoming the maximum resistance as the structure is opened and then snapped into a resting position.

It can be appreciated that the offset can be provided such that the structure is provided with two resting positions that can be of benefit to the use of the device. For example, in one embodiment of the folding chair, it is beneficial for the chair to be folded flat for storage, and for the chair to be put into an open position for use. Accordingly, the offsets can be provided to induce a snap in an intermediate position so that the structure is predisposed to either the open position for use, or the flat position for storage. It can be appreciated in other embodiments, different offsets can be provided to effect different resting positions according to use.

The embodiment shown in FIG. 5 can be provided with flexible hinges disposed at three different face planes, such as two outside face planes and one inside face plane when taken from an edge view. It can also be appreciated for purposes of this description that the support members can be paired differently, whereby FIG. 5 shows one of the pairs of support members at one side of the pyramid support structure 100. Alternatively, one or more of the above-described flexible hinges can be provided whereby the pivot of the hinge is provided between the two support members to be connected and between the faces of at least one of the support members.

FIG. 8 shows a top view of a simplified representation of a pyramid that is not offset to illustrate at least one of the principles at work in an embodiment of the invention which does have an offset. FIG. 8 comprises four diagrams, FIGS. 8A, 8, 8C, and 8D showing four possible positions of elements of a hypothetical pyramid when it is folded. Specifically, FIG. 8A shows a non-overlapping (i.e., convex) open position. FIG. 8B shows a non-overlapping closed position. FIG. 8C shows an overlapping (i.e., concave) open position. FIG. 8D shows an overlapping closed position.

FIG. 9 shows a simplified perspective view of the representations in FIG. 8, comprising FIGS. 9A, 9B, 9C, and 9D which correspond to FIGS. 9A, 9B, 9C, and 9D, respectively. To the extent parts are numbered in FIGS. 8 and 9, they are provided to show aspects corresponding to a pyramid shape and are not indeed to designate structures of an embodiment of the invention, such as shown in other figures.

In FIGS. 8 and 9, the four edges of each pyramid correspond to an axis 104 and are shown where the sides of a pyramid interact and can transfer forces to one another if in an actual physical embodiment. In this non-offset example, the four axes meet at one apex 105. For purposes of illustration, base points 301, 301, 303 and 304 are also shown, which base points represent points along each junction and which can intersect a base plane in one position. Accordingly, where lines are drawn intersecting the base points, an approximate pyramid shape is formed. Specifically, the pyramid has side edges defined by the junctions or axes; base edges defined by the lines intersecting the base points 301, 301, 303, 304; and an apex 105. It is with reference to this basic pyramid shape that concepts related to a pyramid support structure according to the invention can be more readily described.

A basis of the pyramid support structure 100 is the movement of folding a pyramidal geometry. As points 301 and 302 are brought together as shown by the arrows in FIG. 8A, the pyramid structure can be folded into a substantially flat, non-overlapping and closed position as shown in FIG. 8B. In so doing, points 302 and 304 move further apart. In addition, or in the alternative, as points 302 and 304 are brought together as shown by the arrows in FIG. 8C, the pyramid structure 100 can be folded into a substantially flat, overlapping position, as shown in FIG. 8D. It can be appreciated that where a substantially flat non-overlapping folded position is desirable, such as shown in FIG. 8B, the sum of the apex corner angles of a first pair of support members preferably equal the sum of the apex corner angles of a second pair of support members.

As a hypothetically flat structure is folded or unfolded, as shown in FIGS. 8 and 9, no geometric aberration is necessary and all axes 104 can converge on an apex point 105.

However, in practice materials typically have some thickness and hinges 102, or some other flexible connection, is provided to perform a flexible mechanical connection. These factors can limit the range of folding of the pyramid depending upon the design of the structure. For example, the structure 100 can be folded from a position shown in FIG. 8A to a position shown in FIG. 8C, to the extent that the flexible hinge and thickness of the material permit movement, such as at point 302 where one of the junctions may be provided.

Figure 10A:
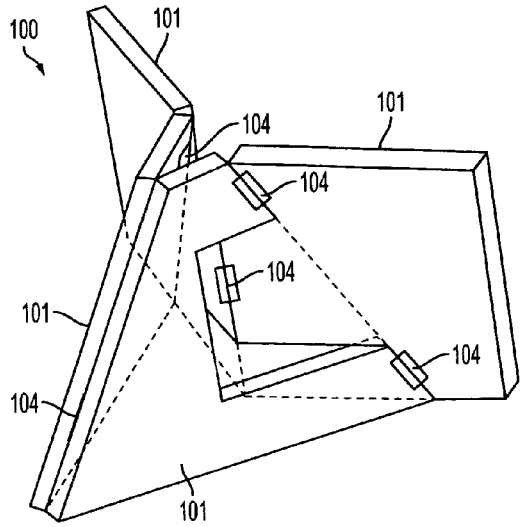
FIG. 10A illustrates a perspective view of an embodiment of a pyramid support structure according to the invention in an open or resting position.
Figure 10B:
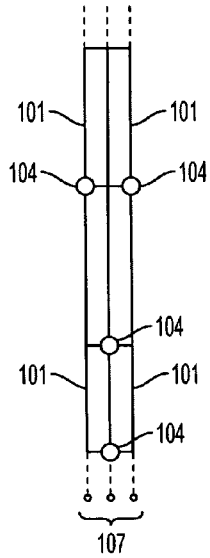
FIG. 10B illustrates a side edge view of an embodiment of a pyramid support structure according to the invention in a closed or folded position.

FIG. 10A shows a perspective view of an alternative embodiment of a pyramid support structure 100 according to the invention in an open or resting position. FIG. 10B shows an edge view of an embodiment of a pyramid support structure 100 according to the invention in a closed or flat position. In the support structure 100 shown in FIGS. 10A and 10, each support member 101 is connected to another support member 101 at a junction which has an associated axis 104. In this embodiment, a hinge 102 can be provided at an edge of a member to provide a flexible connection at the junction. As shown in FIG. 10A, at least two of the support members 101 can overlap to provide a concave type of pyramid, such as shown in FIG. 8C, whereby the thickness of the material comprising the support members can occupy portions of the same plane. In the embodiment of the pyramid support structure 100 shown in FIGS. 10A and 10B, the pivot points of the hinges 102 (and junctions) are offset and provided on different planes when viewed from the edge in a closed position such as shown in FIG. 10B.

Figure 11A:
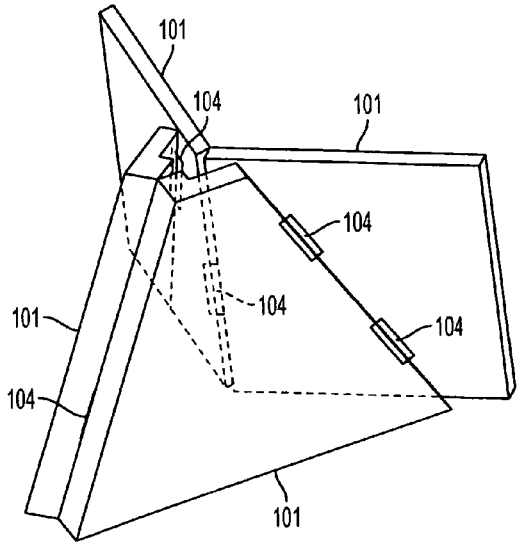
FIG. 11A illustrates a perspective view of an embodiment of a pyramid support structure according to the invention in an open or resting position.
Figure 11B:
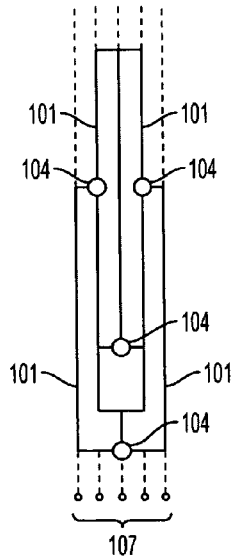
FIG. 11B illustrates a side edge view of an embodiment of a pyramid support structure according to the invention in a closed or folded position.

FIG. 11A shows a perspective view of an embodiment of a pyramid support structure 100 according to the invention in an open or resting position. FIG. 11B shows an edge view of an embodiment of a pyramid support structure 100 according to the invention in a closed or flat position. The embodiment in FIG. 11A is similar to that which is shown in FIG. 10A at least in that two of the support members 101 can overlap to provide a concave type of pyramid, such as shown in FIG. 8C, whereby the material of the support members is structurally offset to occupy different planes. In the embodiment of the pyramid support structure 100 shown in FIG. 11A, the pivot points of the hinges 102 (and junctions) are offset and provided on different planes when viewed from the edge in a closed position such as shown in FIG. 11B.

In both embodiments shown in FIGS. 10A, 10B and 11A, 11B the junctions (and pivot points of the hinges 102) are provided on at least two different planes when viewed in a closed position, and thus do not meet at a common apex 105. By providing at least two junctions or hinges 102 on different planes a pyramid support structure 100 torsional forces and other stress forces can be provided in the structure to effect a desired snapping characteristic as the structure 100 is opened or closed. The offset of the apices the axes meet creates strain which can be transmitted through the material of the support members 101 and the flexible hinges 102. By providing one or more axes 104 whose extensions do not meet at an apex 105, variations in the strain forces can be provided as the pyramid support structure 100 is opened and closed.

It can be appreciated that a convex, or non-overlapping embodiment of the pyramid support structure can also be provided where at least two of the junctions are provided in different planes when viewed in a closed position, and thus do not have a common apex 105.

Variation in strain can be permitted by providing support members 101 fabricated from a flexible material, or providing for a less rigid hinge at at least one of the junctions, among other things. It can be appreciated that the support structure 100 can be provided such that the strain increases either as the pyramid is opened or closed or both. For example, as the pyramid support structure 100 is closed, an increase in strain can be provided which reaches a maximum at an intermediate position, and thereafter is reduced as the structure 100 is closed further.

By providing junctions which do not all meet at a common apex, a snapping of the support member can be provided as it is flexed from a closed to an open position, and vice-versa, thereby disposing the support member to remain in either an open or closed position. It can be appreciated that the flexibility of the material comprising the support member, as well as the play in the flexible hinge 102 can affect the effort required to move the hinge from an opened to a closed position or from a closed to an open position. In one embodiment, the flexible connections 104 are metal hinges. It can be appreciated that the flexible connections 102 can include hinges made of other materials such as plastic, carbon reinforced materials, and other materials sufficient to provide structural support to maintain a flexible connection. Accordingly, factors affecting the amount of snap or strain include the stiffness of the support members 101, the rigidity of the flexible connection 102, the length of the pivot axis or spacing of the flexible connections 102 along the junctions or axes 104, the amount of offset of the axes 104, and the asymmetry of the pyramid 100. Furthermore, a structure 100 according to the invention can be provided comprising a plurality of offset pyramid hinges 100 which can cooperate to form a structure 100 having varying strain characteristics as it is opened and closed.

Figure 12B:
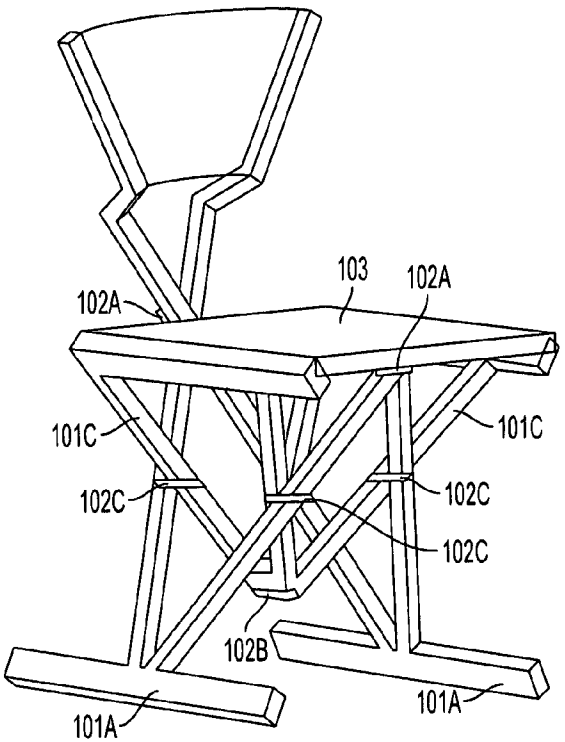
FIG. 12B illustrate a side perspective view of an embodiment of a pyramid support structure according to the invention in an open position.
Figure 12A:
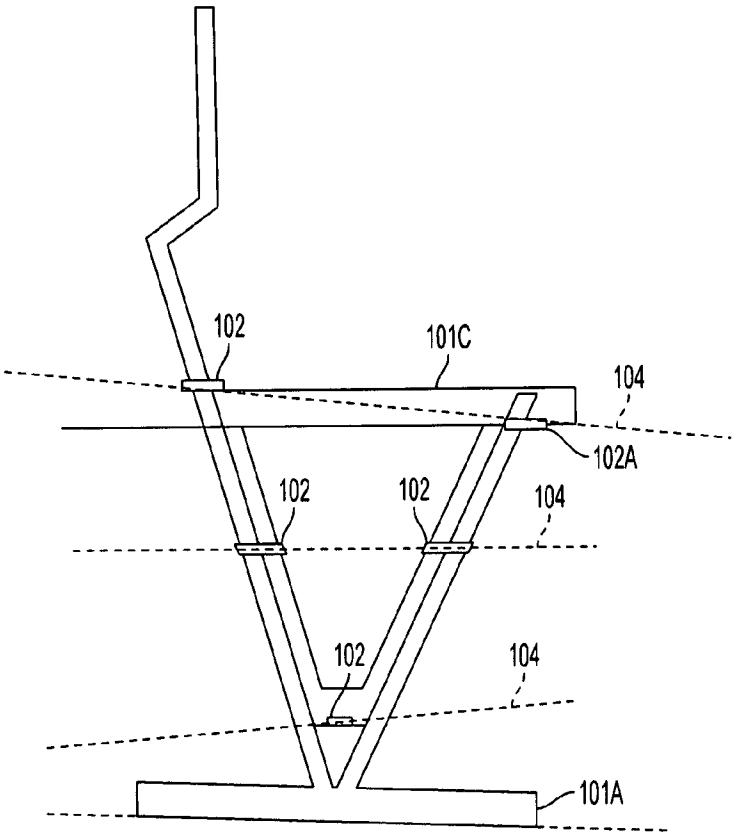
FIG. 12A illustrate a side view of an embodiment of a pyramid support structure according to the invention in an open position.

FIGS. 12A and 12B show an alternative embodiment of a pyramid support structure 100 wherein the support members include leg and back support members 101A, and chair seat support members 101C. In the embodiment of the structure 100 shown in FIG. 12, a pivot is provided as the flexible hinge 102. The pivot 102 can be a dowel or metal rod or any other type of pivot which can rotatably support a connection between support members 101. Specifically a first pair of leg and back support members 101A are provided with chair legs and rotatably connected to one another at at least one first hinge 102A. In addition, a second pair of seat support members 101C are rotatably connected to one another at at least one second hinge 102B. The first pair of leg support members 101A are rotatably connected to the second pair of chair seat support members 101C at at least one third hinge 102C. A chair back can be provided and connected to the first pair of support members 101A to provide a back rest for a user, and can provide a limit to the opening of the chair. In addition, or in the alternative, a chair seat can be connected to the third pair of support members 101C to provide a seat rest for a user, and can provide a limit to the opening of the chair.

The axes 104 on which the hinges 102 lie are provided such that at least two of the axes are not parallel. In addition, two of the axes 104 can be provided to meet at a first virtual apex 105 in the distance, and such apex 104 is offset from where any other two apices 104 formed by other axes 104 which can be provided to meet in the distance (not shown). It can be appreciated that the angles at which the apices form a virtual apex 105 can be very small to effect a snapping motion to the opening of the chair so that the chair can be disposed to be in either an open or closed position.

The invention claimed is:

1. An offset pyramid hinge folding chair, comprising:

at least one pyramid support structure having at least four support members, wherein two of the support members are chair leg support members, wherein two of the support members are chair seat support members, wherein each of the support members are flexibly connected to two other support members at two axes, wherein the axes form at least a portion of an offset pyramid shape in an open position, wherein the support members are disposed relative to one another and form a flattened shape and lay substantially flat against one another in a folded position, and wherein the axes are offset, and at least two of the axes do not meet at a common apex, wherein said chair leg support members include two chair legs, a chair back connected to at least one of said support members, and wherein said chair leg support members include a chair seat wherein two of the support members are chair back support members, wherein the chair back support members are flexibly connected to each other at an inside plane, wherein the chair leg support members are flexibly connected to each other at an inside plane, wherein the chair seat support members, are flexibly connected to each other at an inside plane, wherein each chair back support member is flexibly connected to a chair leg support member at an outside plane, wherein each chair back support member is flexibly connected to a chair seat support member at an outside plane, and wherein each chair seat support member is flexibly connected to a chair leg support member at an outside plane.

2. A pyramid support structure as in claim 1, comprising a plurality of apices when viewed in a flattened position, wherein each axis meets another axis at an apex, and at least two of said apices are offset from one another.

3. A pyramid support structure as in claim 1, wherein at least two of said axes are provided in different planes in a folded position.

4. A pyramid support structure as in claim 1, wherein two of the support members are chair back support members, wherein the chair back support members are flexibly connected to each other at an outside plane, wherein the chair leg support members are flexibly connected to each other at an outside plane, wherein the chair seat support members are flexibly connected to each other at an outside plane, wherein each chair back support member is flexibly connected to a chair leg support member at an inside plane, wherein each chair back support member is flexibly connected to a chair seat support member at an inside plane, and wherein each chair seat support member is flexibly connected to a chair leg support member at an inside plane.

5. An offset pyramid hinge folding chair, comprising:

at least one pyramid support structure having at least four support members, wherein each of the support members are flexibly connected to two other support members at two axes, wherein the support members form at least a portion of an offset pyramid shape in an expanded position, wherein the support members are disposed relative to one another and form a flattened shape and lay substantially flat against one another in a folded position, and wherein at least two of said axes are provided in different face planes in a folded position;

two chair legs connected to two of the support members, a chair back connected to at least one of the support members, and a chair seat connected to at least one of the support members, wherein said at least four support members comprise a first pair of support members and a second pair of support members, wherein the support members of the first pair of support members are connected flexibly to each other at an inside plane, wherein the support members of the second pair of support members are connected flexibly to each other along an edge of an inside face of the support members, and wherein each of the support members of the first pair of support members is flexibly connected to a support member of the second pair at an edge of an outside face of the support member.

6. A pyramid support structure as in claim 5, further comprising a third pair of support members flexibly connected to each other, and wherein each support member of said third pair of support members is flexibly connected to a support member of another pair of support members at an additional axis.

7. A pyramid support structure as in claim 6, wherein said additional axis forms at least one apex with at least one of said axes that is offset from at least one other apex formed by said axes.

8. A pyramid support structure as in claim 5, wherein a first support member of said first pair of support members has a first axis, and a second support member of said first pair of support members has a second axis, and said first axis and said second axis meet at a first apex;

a first support member of said second pair of support members has a first axis, and a second support member of second pair of support members has a second axis, and said first axis and second axis meet at a second apex; and wherein said first apex is offset from said second apex.

9. A pyramid support structure as in claim 5, wherein said at least four support members comprise a first pair of support members and a second pair of support members, wherein the support members of the first pair of support members are connected flexibly to each other along an axis at an outside plane, wherein the support members of the second pair of support members are connected flexibly to each other along an axis at an outside plane, and wherein each of the support members of the first pair of support members is flexibly connected to a support member of the second pair at an axis at an inside plane.

10. An offset pyramid hinge for a folding chair, comprising:

at least one pyramid support structure having at least four support members and at least four axes, said four axes including a first axis, a second axis, a third axis and a fourth axis wherein two of the support members are flexibly connected to each other at the first axis;

wherein two of the support members are flexibly connected to each other at the second axis;

wherein two of the support members are flexibly connected to each other at the third axis;

wherein two of the support members are flexibly connected to each other at the fourth axis;

wherein the at least four axes form the approximate shape of a offset pyramid when the support members are in an open position, said pyramid having at least two apices, each of said apices corresponding to an intersection of at least two of said axes, and wherein at least two of said apices are offset from one another, thereby comprising at least two offset apices whereby the support members lie flat in a closed position.

11. An offset pyramid hinge according to claim 10, wherein two of the support members include a chair seat, wherein two of the support members include two chair legs, and wherein two of the support members includes a chair back.

12. An offset pyramid hinge according to claim 10, wherein the first axis and second axis intersect at an acute angle, wherein the second axis and third axis intersect at an acute angle, wherein the third axis and fourth axis intersect at an obtuse angle, and wherein the fourth axis and first axis intersect at an obtuse angle.

13. An offset pyramid hinge according to claim 10, wherein the first axis and second axis intersect at an acute angle when the support members are in an open position, wherein the second axis and third axis intersect at an acute angle when the support members are in an open position, wherein the third axis and fourth axis intersect at an obtuse angle when the support members are in an open position, wherein the fourth axis and first axis intersect at an obtuse angle when the support members are in an open position.

14. An offset pyramid hinge according to claim 10, wherein the first axis and second axis are parallel in a folded position.

15. An offset pyramid hinge according to claim 10, wherein the first axis and second axis are parallel in an open position.

16. An offset pyramid hinge according to claim 10, wherein the support members are disposed relative to one another and form a flattened shape and lay substantially flat against one another in a folded position, and wherein at least two of said axes are provided in different of planes in a folded position.

17. An offset pyramid hinge according to claim 10, wherein the support members lie flat in a closed position.

18. An offset pyramid hinge according to claim 10, wherein said offset apices first become closer together as the support members are moved from a closed position to an open position, and then become further apart as the support members are moved further from a closed position to an open position.

19. An offset pyramid hinge according to claim 10, wherein said offset apices first become closer together as the support members are moved from an open position to a closed position, and then become further apart as the support members are moved further from an open position to an closed position.

20. An offset pyramid hinge according to claim 10, wherein at least two of said support members comprise a first symmetrical pair of support members and at least two of said support members form a second symmetrical pair of support members, and said first and second symmetrical pairs of support members are asymmetrical with respect to one another.

21. An offset pyramid hinge according to claim 10, wherein said offset apices come together and then move apart as the offset pyramid hinge is moved from an open position toward a closed position.

22. An offset pyramid hinge according to claim 10, whereby the offset apices impart forces to the structural members which, when the offset pyramid hinge is moved from an open to a closed position, create increasing and then decreasing resistance to opening.

23. An offset pyramid hinge according to claim 10, whereby the offset apices impart a torsional force to at least one of the axes when the offset pyramid hinge is moved from an open to a closed position.

24. An offset pyramid hinge according to claim 10, wherein the axes are offset, and at least two of the axes do not meet at a common apex.

* * * * *